US005246305A

United States Patent [19]

Peek

[11] Patent Number: 5,246,305

[45] Date of Patent: Sep. 21, 1993

[54] CONVEYOR AND METHOD FOR TRANSFERRING BARRIER SYSTEMS

[75] Inventor: Steven L. Peek, Walnut Grove, Calif.

[73] Assignee: Barrier Systems, Inc., Sausalito, Calif.

[21] Appl. No.: 792,223

[22] Filed: Nov. 12, 1991

[51] Int. Cl.[5] ..... E01F 13/00

[52] U.S. Cl. ..... 404/6; 404/72

[58] Field of Search ..... 404/6, 73, 72, 101; 256/13.1; 198/309, 816.2; 116/63 P; 414/567; 16/361, 285

[56] References Cited

U.S. PATENT DOCUMENTS

| | | | |
|---|---|---|---|
| 4,167,826 | 9/1979 | Feliz | 404/84.05 X |
| 4,500,225 | 2/1985 | Quittner | 404/6 |
| 4,632,598 | 12/1986 | Richards | 404/6 |
| 4,653,954 | 3/1987 | Booth et al. | 404/6 |
| 4,666,332 | 5/1987 | Burgett | 404/72 X |
| 4,806,044 | 2/1989 | Duckett | 16/361 X |
| 4,828,425 | 5/1989 | Duckett | 16/361 X |
| 4,955,753 | 9/1990 | McKay | 256/13.1 X |

*Primary Examiner*—Kenneth J. Dorner
*Assistant Examiner*—Nancy P. Connolly
*Attorney, Agent, or Firm*—Phillips, Moore, Lempio & Finley

[57] ABSTRACT

A mobile transfer and transport vehicle is adapted to move a barrier system, having a plurality of interconnected and closely spaced modules, on a roadway or the like. The vehicle includes a conveyor having series of guide and support rollers for engaging, supporting, lifting and transferring the barrier system from a first side of said vehicle to a second side thereof. At least some of the rollers are spring-biased into engagement with the modules when they move through curved portions of a serpentine-like transfer path through the conveyor.

11 Claims, 3 Drawing Sheets

CONVEYOR AND METHOD FOR TRANSFERRING BARRIER SYSTEMS

TECHNICAL FIELD

This invention relates generally to a mobile transfer and transport vehicle and more particularly to the conveyor of a vehicle adapted to reposition a barrier system on a roadway or the like.

BACKGROUND OF THE INVENTION

The type of barrier system disclosed in U.S. Pat. No. 4,806,044 is adapted to be lifted by a mobile transfer and transport vehicle and moved to a selected position on a roadway or the like. Moveable barrier systems of this type find particular application at roadway construction sites and on roadways and bridges whereat the groupings of incoming and outgoing lanes of traffic must be varied, particularly during commute hours.

The barrier system comprises a series of interconnected concrete modules hinged together to form a continuous chain. The cross-section of each module is similar to that of a "Jersey-type" barrier, but has a T-shaped top section. A standard module has a height approximating thirty-two ins., a length approximating thirty-seven ins. and weighs approximately 1400 lbs. The modules are pivotally connected together by inserting a steel pin through hinge components attached to the ends of each adjacent pair of modules.

The self-propelled transfer and transport vehicle includes a conveyor system for shifting the barrier system laterally across the roadway from a first side to a second side of the vehicle. The shift or lateral displacement of the barrier system can be normally varied from four to eighteen feet. The conveyor system includes a plurality of guide and support wheels or rollers that function to engage beneath the T-shaped top section of the modules for lifting and transfer purposes.

The modules move through a serpentine-like transfer path (elongated "S" curve) for accurate positioning thereof to define a repositioned lane line. The modules are moved at a speed approximating five mph through the vehicle and must move through curved path portions (FIG. 1) during the transfer process. As described herein, applicant has found it desirable to provide means for biasing guide and support rollers into engagement with the modules when they pass through such curved portions of the transfer path.

SUMMARY OF THE INVENTION

An object of this invention is provide an improved conveyor for a mobile transfer and transport vehicle and a unique method for transferring a barrier system on a roadway or the like.

The barrier system comprises a plurality of interconnected modules and the vehicle includes a conveyor for engaging, supporting, lifting and transferring the barrier system from a first side of the vehicle to a second side thereof, along a generally serpentine-like transfer path. The conveyor includes series of spaced guides, such as guide and support wheels or rollers, disposed adjacent to the path. In one aspect of this invention, biasing means are provided for urging at least some of the guides into engagement with the modules, particularly when the modules are moved through each curved path portion of the serpentine-like transfer path.

In another aspect, the invention is defined as a method including the step of applying a biasing force to at least some of the guides to urge them into engagement with the modules.

Thus, the overall structural integrity, life expectancy and efficiency of the conveyor is improved and the individual modules of the barrier system can be made longer without having to lengthen the transfer and transport vehicle.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
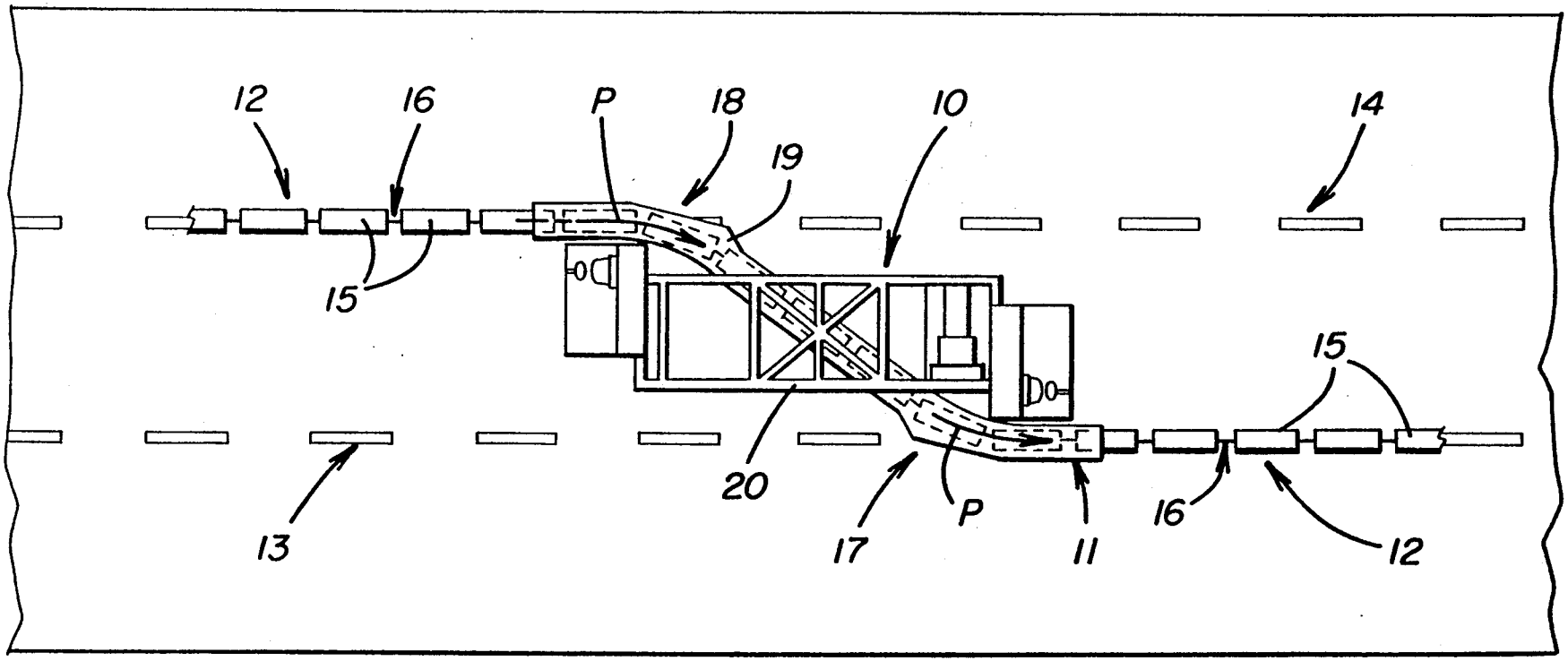
FIG. 1 is a top plan view schematically illustrating a mobile transfer and transport vehicle in the process of transferring a barrier system from a first position on a roadway to a laterally displaced second position thereon.

FIG. 1 schematically illustrates a transfer and transport vehicle 10 having a conveyor adapted to engage, support, lift and transfer a barrier system 12 on a roadway. As described in U.S. Pat. Nos. 4,500,225 and 4,806,044, the barrier system is adapted to be transferred from a first position to a laterally displaced second position at a construction site or on a roadway for delineation and anti-crash barrier purposes. In the illustrated application, the vehicle can be moved rightwardly to transfer the barrier system from a standard first lane marker 13 to a parallel second lane marker 14 on the roadway.

As described in the above-referenced patents, barrier system 12 comprises a plurality of closely spaced and free-standing barrier modules 15 pivotally interconnected together at hinge connections 16 to form a chain-like system. As further shown in FIG. 1, transfer of the barrier system requires that they move through a serpentine-like path P (elongated "S" curve), including generally straight portions merged together at curved path portions defined at curved sections 17 and 18 of conveyor 11. It should be understood that mobile vehicle 10, suitably mounted on a plurality of roadwheels (not shown), can be moved in the opposite (leftward) direction in FIG. 1 to reverse the transfer of barrier system 12, i.e., from lane marker 14 to lane marker 13.

Experimentation has shown that it is desirable to provide means between conveyor 11 and barrier system 12 to accommodate displacement of barrier modules 15 when they move through curved sections 17 and 18 of the conveyor. In addition, it has proven further desirable for various barrier system applications to utilize barrier modules having lengths greater than standard (e.g., thirty-seven ins.). As described hereinafter, the above objects have been achieved by providing means for biasing guide and support rollers of conveyor 11 into engagement with the individual barrier modules 15 when they move through curved sections 17 and 18.

Figure 2:
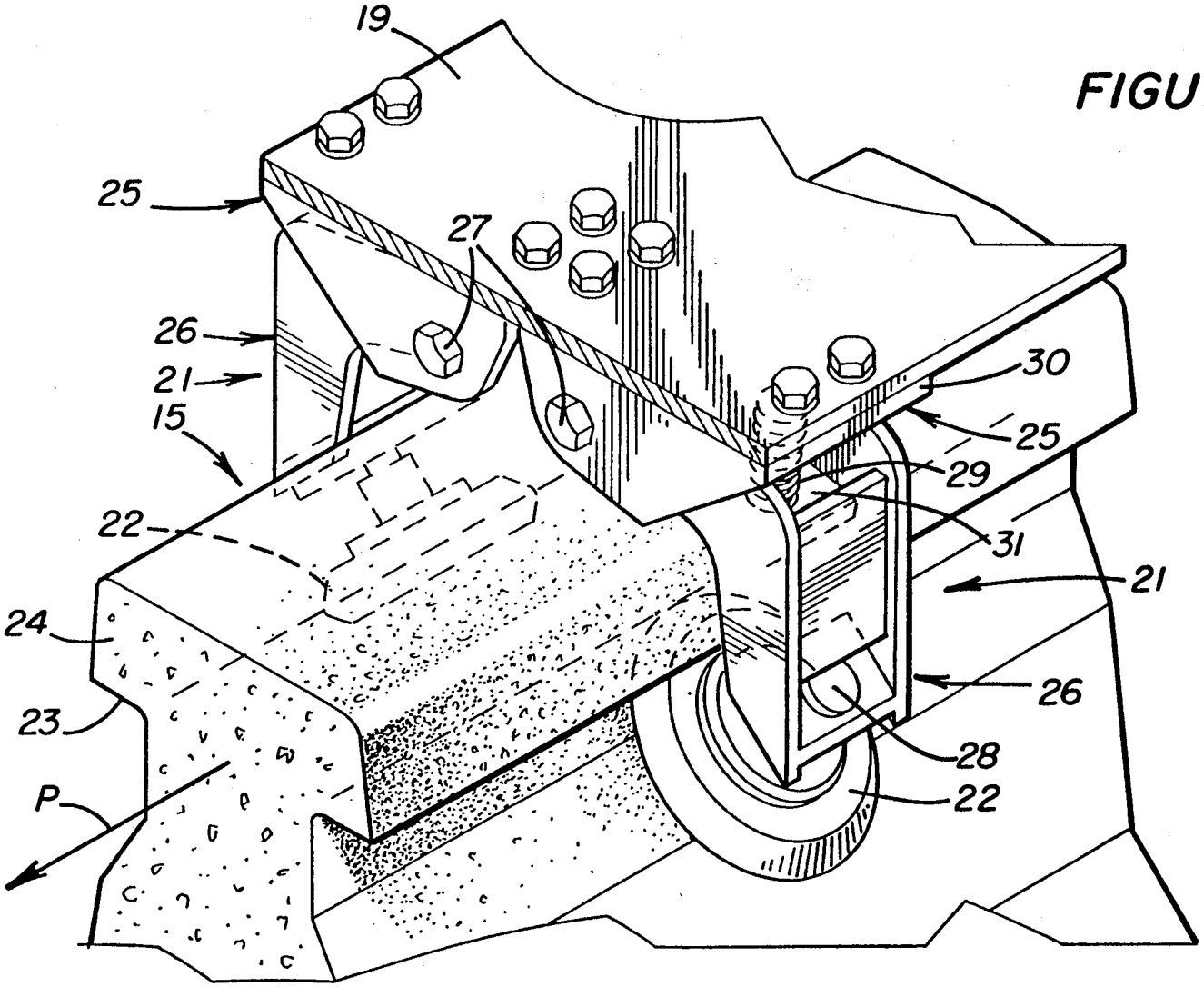
FIG. 2 is an enlarged isometric view that is sectioned to illustrate support of an individual module of the barrier system by a pair of guide and support roller assemblies of a conveyor.
Figure 3:
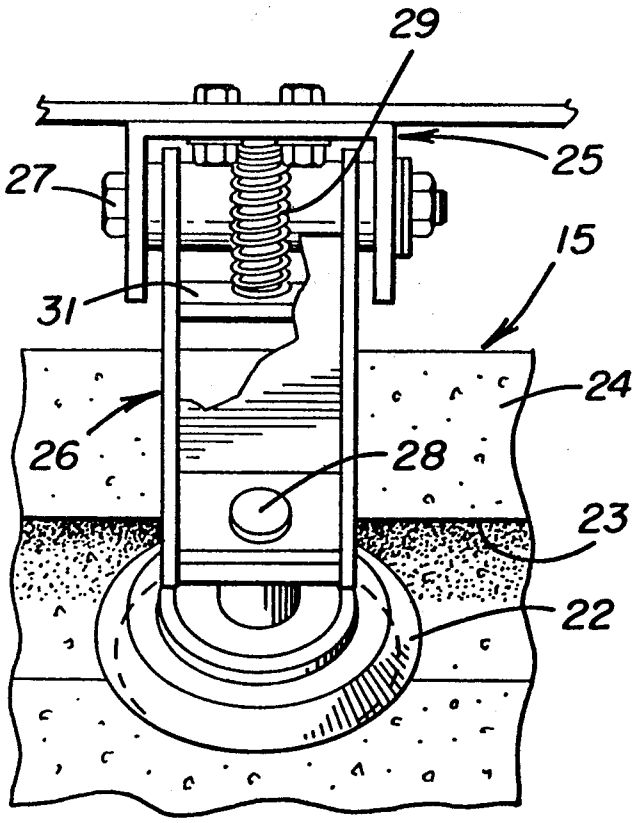
FIG. 3 is a partially sectioned side elevational view of one of the guide and support roller assemblies.
Figure 4:
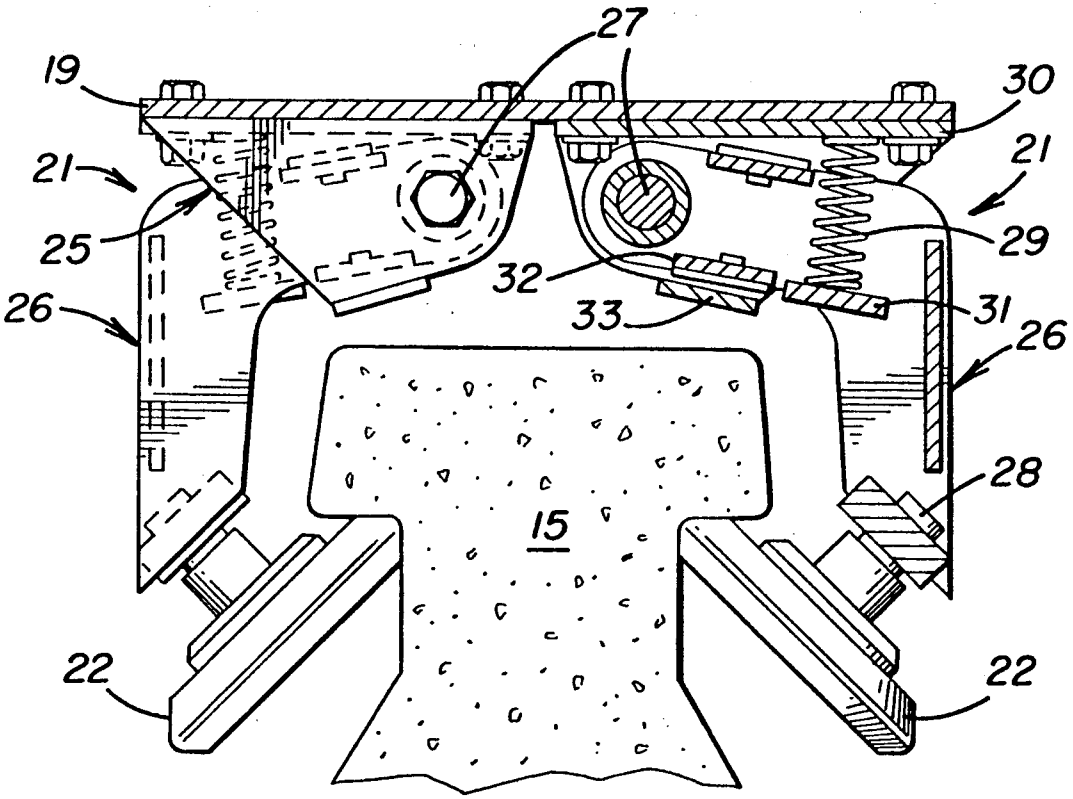
FIG. 4 is a cross-sectional view illustrating one of the guide and support roller assemblies in side elevation and the other one in section for clarification purposes.

Referring to FIGS. 2–4, conveyor 11 includes a partially illustrated carrier frame 19 adapted to be suitably secured beneath a main frame 20 of vehicle 10 (FIG. 1). As described in the above-referenced patents, opposed first and second series of fixed angled wheels or guide and support rollers engage either side of the modules when they move along the generally straight path portions of serpentine-like path P. As shown in FIG. 2, when the modules move through each curved section 17 and 18 of conveyor 11 (FIG. 1), spring-biased guide means are provided to accommodate the turning radii of the modules.

In the illustrated embodiment, the guide means comprises a pair of identical guide and support roller assemblies 21. Each assembly includes a roller 22 that is spring-biased into engagement with a respective side of module 15. Each roller engages within an undercut 23, defined at a T-shaped upper section 24 of the module, when the modules move thereby in response to movement of vehicle 10.

As shown in FIGS. 2–4, each guide and support roller assembly 21 further includes a bracket 25 secured beneath carrier frame 19 and an arm 26 having its first end pivoted on the bracket by a pivot bolt 27. The first end of arm 26 thus overlies module 15 of the barrier system and a second end of the arm overlies a respective side thereof. Each guide and support roller 22 is rotatably mounted on the second end of a respective arm 26 by an axle 28 in a conventional manner.

In the embodiment illustrated in FIGS. 2–4, the biasing means for biasing each roller 22 into engagement with module 15 constitutes a suitably calibrated compression coil spring 29. The spring is suitably mounted and anchored between an upper plate 30 of bracket 25 and a cross plate 31 of arm 26. The spring will thus urge arm 26 and roller 22 to pivot inwardly toward path P and into supporting engagement within a respective undercut 23 of barrier module 15.

It should be understood that the number, disposition and construction of spring 29 can be varied, as well-known to those skilled in the art. Further, other types of springs could be utilized, i.e., pneumatic, hydraulic, elastomeric pads, leaf or tension springs, etc. As more clearly shown in FIG. 4, a cross-plate 32, secured on arm 26, is adapted to engage a cross-plate 33 of bracket 25 to provide stop means for delimiting pivotal movement of support arm 26, inwardly towards path P.

The method for transferring barrier system 12 through serpentine-like path P by vehicle 10 will thus include the step of applying a force to at least some (preferably all) of guide and support rollers 22 that are disposed along the curved path portions of path P, located at curved sections 17 and 18 of conveyor 11 (FIG. 1), to urge such rollers into engagement with the barrier modules. In the preferred embodiment of this invention, the biasing force is occasioned by one or more compression coil springs 29 that are suitably calibrated to permit flexing of arm 26 to compensate for the movement of the modules therepast. As described above, stop means 32,33 (FIG. 4) are provided to delimit inward pivoting of arm 26 to prevent collapse of the arms which could interfere with the smooth transition of the modules along path P.

I claim:

1. A mobile transfer and transport vehicle in combination with a barrier system having a plurality pivotally interconnected and closely spaced modules adapted to be positioned in free-standing relationship on a roadway or the like, said vehicle comprising a frame and conveyor means mounted on said frame engaging, supporting, lifting and transferring said barrier system from a first side of said vehicle to a second side thereof along a generally serpentine-like transfer path, said conveyor means including a plurality of spaced guide means disposed adjacent to said path engaging and supporting said modules and biasing means, mounted on said vehicle, biasing at least some of said guide means into engagement with said modules.

2. The combination of claim 1 wherein said serpentine-like path includes at least one curved path portion and wherein the guide means disposed adjacent to the curved path portion of said path are urged into engagement with said modules by said biasing means 3. The combination of claim 2 wherein said guide means includes a first series and a second series of guide and support roller assemblies mounted on either side of said path.

4. The combination of claim 3 wherein each of said guide and support roller assemblies includes a support arm having a first end overlying said barrier system and a second end overlying a side of said barrier system, pivot means pivotally mounting the first end of said support arm on said frame and a support roller rotatably mounted on the second end of said support arm, said support roller positioned to engage said modules.

5. The combination of claim 4 wherein each of said guide and support roller assemblies further includes a mounting bracket secured to said frame and wherein the first end of said support arm is pivotally mounted on said mounting bracket by said pivot means and said biasing means is mounted between said mounting bracket and said support arm urging said support arm and support roller to pivot inwardly towards said path.

6. The combination of claim 5 wherein said biasing means comprises a compression coil spring.

7. The combination of claim 5 further comprising stop means delimiting pivoting of said support arm inwardly towards said path.

8. A mobile transfer and transport vehicle having conveyor means engaging, supporting, lifting and transferring a barrier system, including a plurality of pivotally interconnected modules, from a first side of said vehicle to a second side thereof along a generally serpentine-like transfer path having at least one curved path portion, said conveyor means comprising a carrier frame, and first and second series of guide and support roller assemblies mounted on either side of said path, each including a support roller adapted to engage and support said modules, the support roller assemblies mounted adjacent to the curved path portion of said path comprising a support arm having first and second ends, pivot means for pivotally mounting the first end of said support arm on said carrier frame and a said support roller rotatably mounted on the second end of said support arm, and biasing means urging such support roller towards said path and into engagement with said modules.

9. The combination of claim 8 wherein each of said guide and support roller assemblies further includes a mounting bracket secured to said carrier frame and wherein the first end of said support arm is pivotally mounted on said mounting bracket by said pivot means and said biasing means is mounted between said mounting bracket and said support arm urging said support arm and support roller to pivot inwardly towards said path.

10. The vehicle of claim 9 wherein said biasing means comprises a compression coil spring.

11. The vehicle of claim 9 further comprising stop means delimiting pivoting of said support arm inwardly towards said path.

* * * * *